United States Patent [19]

Hibbard

[11] Patent Number: 4,917,277

[45] Date of Patent: Apr. 17, 1990

[54] PLEAT FORMING APPARATUS

[76] Inventor: Retta J. Hibbard, 140 Regier Springs, Sparks, Nev. 89436

[21] Appl. No.: 321,716

[22] Filed: Mar. 10, 1989

[51] Int. Cl.[4] ..... D06J 1/06

[52] U.S. Cl. ..... 223/34

[58] Field of Search ..... 223/28, 33, 34, 35, 223/36, 37; 112/136

[56] References Cited

U.S. PATENT DOCUMENTS

| | | | |
|---|---|---|---|
| 2,863,592 | 12/1958 | Terry . | |
| 3,369,303 | 2/1968 | Henry . | |
| 3,454,203 | 7/1969 | Nelson . | |
| 3,667,677 | 6/1972 | Sprong | 223/34 |
| 3,726,449 | 4/1973 | Kern | 223/35 |
| 3,974,946 | 8/1976 | Gentry . | |
| 4,036,414 | 7/1977 | Miranda | 223/28 |
| 4,542,602 | 9/1985 | Hoverson | 223/34 |

*Primary Examiner*—Werner H. Schroeder
*Attorney, Agent, or Firm*—Leon Gilden

[57] ABSTRACT

A pleat forming apparatus is formed with a "U" shaped framework including a plurality of rotatably mounted threaded rods therethrough. The threaded rods are mounted rotatably through forwardly extending legs of the "U" shaped frame wherein the threaded rods are mounted from opposite directions through the legs of the framework and through pleat arm supports mounting the pleat arms of the instant invention. The pleat arms include telescoping arms thereover for dimensionally lengthening the effective span of the pleat arms. The threaded rods are rotatably mounted to vary the spacing of the pleat arms to accommodate various material to be pleated and effect a desired pleat spacing.

7 Claims, 1 Drawing Sheet

PLEAT FORMING APPARATUS

BACKGROUND OF THE INVENTION

1. Field of the Invention

The field of invention relates to pleating apparatus, and more particularly pertains to a new and improved pleat forming apparatus wherein the pleat forming fingers are spatially and longitudinally adjustable to accommodate various materials to be pleated.

2. Description of the Prior Art

The use of pleating apparatus is well known in the prior art. Heretofore the pleating apparatus has failed to provide the adjustment of the pleat arms relative to one another, as well as providing pleat arms of various lengths to accommodate a wide range of materials to be pleated. The material to be pleated is merely woven about the pleat arms wherein a heating device is utilized to heat the material overlying the pleat forming fingers to create the desired pleating pattern. For example, U.S. Pat. No. 2,683,592 to Terry sets forth a pleating apparatus utilizing fixed pleat fingers fixed at both their forward and rearward ends whereby the length of material positioned therethrough is restricted, as opposed to the openended pleating apparatus of the instant invention which provides not only linear adjustment of the pleat arm length, but enables a desired spacing of the pleat arms as well.

U.S. Pat. No. 3,369,303 to Henry sets forth a pleating arrangement to provide for various pleats of desired configuration, such as circular. The pleats, as is well known in the prior art, are formed about fixed fingers wherein a pleater is utilized formed initially in a substantially mono-planar state which may be modified to create various arcs and the like for pleat forming.

U.S. Pat. No. 3,454,203 to Nelson sets forth a pleat forming guide setting forth guide means along the edges for indicating a manner of folding the pleats with a second guide means disposed along the first guide means for aligning the guide on the material with a third guide means provided for positioning stitching when sewing the guide on the material to be pleated.

U.S. Pat. No. 8,667,677 to Sprong sets forth an adjustable fabric pleater wherein the arms are individually adjustable in a spaced relationship relative to one another and are formed with tapered forwardly projecting fingers which are of a fixed length, as opposed to the instant invention, and further fails to provide the simultaneous spacing of the pleat arms, as desired, as presented by the instant invention.

U.S. Pat. No. 3,974,946 to Gentry utilizing a substantially flat plastic sheet provided with alternate scorings on each side of the plastic sheet wherein the scoring lines are parallel to each other and are equally spaced from each other to thereby facilitate folding material in accordion style to create a pleating pattern.

As such, it may be appreciated that there is a continuing need for a new and improved pleat forming apparatus wherein the same addresses both the problems of effectiveness and adjustability in accommodating various material lengths and thicknesses, and in this respect, the present invention substantially fulfills this need.

SUMMARY OF THE INVENTION

In view of the foregoing disadvantages inherent in the known types of pleat forming apparatus now present in the prior art, the present invention provides a pleat forming apparatus wherein the same provides for plural adjustment of the pleating arms to accommodate material to be pleated of various thickness and lengths. As such, the general purpose of the present invention, which will be described subsequently in greater detail, is to provide a new and improved pleat forming apparatus which has all the advantages of the prior art pleat forming apparatus and none of the disadvantages.

To attain this, the present invention comprises a "U" shaped frame including a plurality of threaded rods extending through the legs of the frame wherein the threaded rods are of equal pitch and diameter and are further directed in opposite directions through the legs of the frame to enable spatial adjustment of the pleat arms of the invention by simultaneous rotation of associated handles of the threaded rods. The handles are rotatably mounted onto plates which are removably mounted to the threaded rods to enable compact storage of the apparatus when not in use.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved pleat forming apparatus which has all the advantages of the prior art pleat forming apparatus and none of the disadvantages.

It is another object of the present invention to provide a new and improved pleat forming apparatus which may be easily and efficiently manufactured and marketed.

It is a further object of the present invention to provide a new and improved pleat forming apparatus which is of a durable and reliable construction.

An even further object of the present invention is to provide a new and improved pleat forming apparatus which is susceptible of a low cost of manufacture with regard to both materials and labor, and which accordingly is then susceptible of low prices of sale to the consuming public, thereby making such pleat forming apparatus economically available to the buying public.

Still yet another object of the present invention is to provide a new and improved pleat forming apparatus which provides in the apparatuses and methods of the prior art some of the advantages thereof, while simultaneously overcoming some of the disadvantages normally associated therewith.

Still another object of the present invention is to provide a new and improved pleat forming apparatus wherein the same enables spatial and longitudinal adjustment of the pleat arms to accommodate various types and lengths of material to be pleated.

Still a further object of the present invention is to provide a new and improved pleat forming apparatus wherein the same is provided with rotating handles removably mounted to the organization to enable compact storage of the apparatus when not in use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
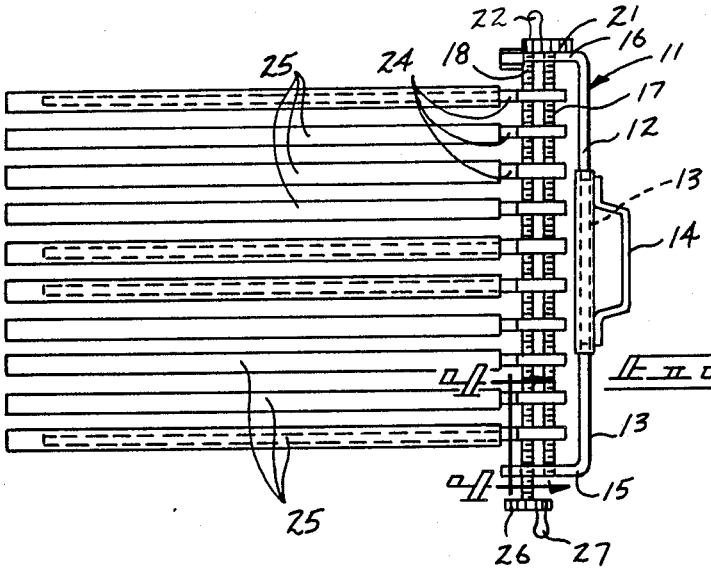
FIG. 1 is a top orthographic view of the instant invention.
Figure 2:
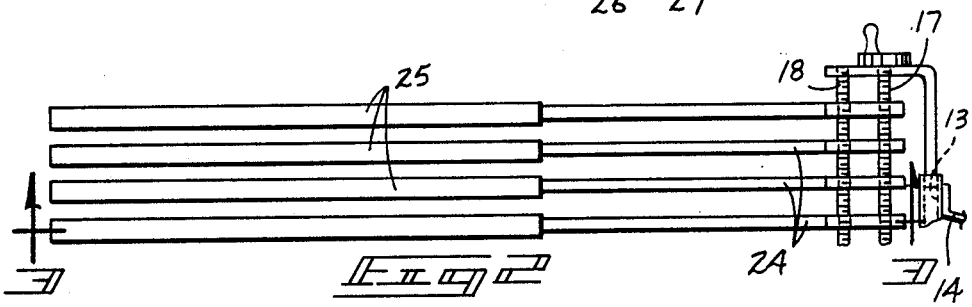
FIG. 2 is a segmented top orthographic view of the instant invention.
Figure 3:
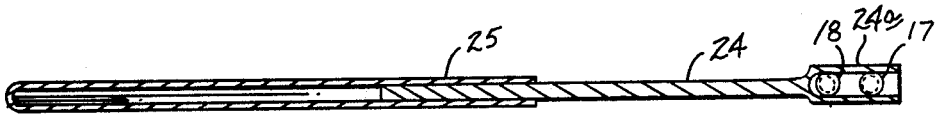
FIG. 3 is an orthographic view taken along the lines 3—3 of FIG. 2 in the direction indicated by the arrows.
Figure 4:
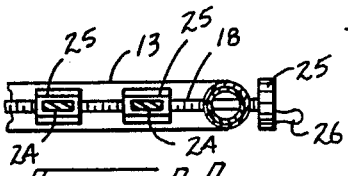
FIG. 4 is an orthographic view taken along the lines 4—4 of FIG. 1 in the direction indicated by the arrows.

With reference now to the drawings, and in particular to FIGS. 1 to 5 thereof, a new and improved pleat forming apparatus embodying the principles and concepts of the present invention and generally designated by the reference numeral 10 will be described.

More specifically, it will be noted that the pleat forming apparatus I0 essentially comprises a "U" shaped frame 11 formed with a rear spine including a right support bar 12 telescopingly receiving a left support bar 13 therewithin through a sliding relationship therebetween. A handle 14 is pivotally mounted to the right support bar 12 for transport of the apparatus. The rear spine includes an orthogonally extending left leg 15 at one terminal end thereof with a right leg 16 parallel to the left leg 15. The left and right legs 15 and 16 receive therethrough a first threaded rod 17 with a spaced parallel second threaded rod 18. The threaded rods are of equal pitch, thread direction (i.e. right or left), and diameter and are directed through opposite sides of the "U" shaped frame. The forward end of the first set of rods 17 includes a first crank plate 21 fixedly secured thereto with a handle orthogonally extending outwardly of the crank plate 21 and offset from the central axis thereof. The second threaded rod 18 includes a parallel and equal second crank plate 26 with an outwardly extending second handle 27 extending outwardly of and axially offset from the second crank plate 26.

Figure 5:
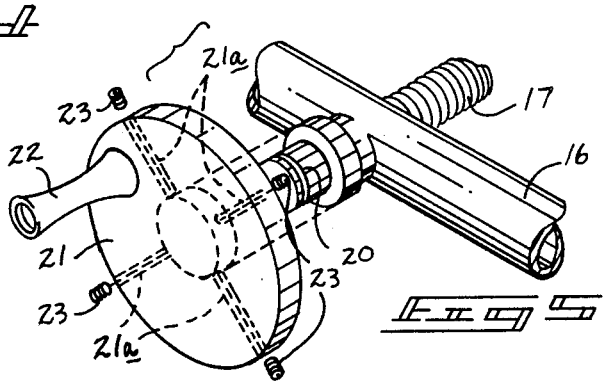
FIG. 5 is an isometric illustration, somewhat expanded, of the rotating handle structure of the instant invention.

Reference to FIG. 5 illustrates the association of the first crank plate 21 and handle 22 to the first threaded rod 17, however it is understood that the second threaded rod 18 and the associated crank plate handle are of equal construction. The crank plate 21 includes plural pairs of diametrically opposed and threaded fasteners 23 threadedly receivable within the diametrically aligned plural pairs of threaded bores **21*a*. The threaded bores 21*a* extend diametrically through the plate-like crank plate member 21 and allow the forward ends of the respective threaded fasteners 23 receivable from the threaded bores to frictionally engage the forward end of the first threaded rod 17 formed with a groove 20 extending around the periphery of the threaded rod 17. In this manner, the crank plate 21 and associated handle 22 may be removed from the first threaded rod 17** for storage of the apparatus enabling the apparatus to be received within a relatively compact storage area.

The threaded bores are threadedly received through parallel pleat arm supports **24*a*. The pleat arms 24 are parallel to each other and extending outwardly from the supports 24*a* to form a series of first pleat arms 24 that are in turn frictionally and telescopingly received within movably mounted coextensive second pleat arms 25. In this manner, it is understood that the pleat arms 24 and 25 may be telescopingly adjusted relative to one another to provide a length, as desired, to accommodate fabric of a corresponding length. Further, as the handles 22 and 27 are rotated in like directions, the plate arm supports 24*a* and associated pleat arms are moved parallel relative to one another to increase or decrease the spacing therebetween wherein the adjustment spacing is accommodated by the telescoping relationship of the left support bar 13 within the right support bar 12**, as discussed above.

As to the manner of usage and operation of the present invention, the same should be apparent from the above disclosure and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows wherein I claim:

1. A pleat forming apparatus comprising, a framework including first and second spaced adjustment means mounted through said framework for spacedly adjusting a predetermined spacing between a plurality of parallel first pleat arms, said first pleat arms receiving the first and second adjustment means therethrough, and wherein the first and second adjustment means are threaded rods including a first and second threaded rod rotatably mounted through the framework, and wherein the threaded rods are of equal pitch, diameter, and thread orientation.

2. A pleat forming apparatus as set forth in claim 1 wherein the first and second threaded rods each include at a forward terminal end thereof exteriorly of the framework a crank plate axially aligned with the associated threaded rod, and a handle mounted to the crank plate.

3. A pleat forming apparatus as set forth in claim 2 wherein the crank plate includes plural pairs of diametrically aligned threaded bores receiving threaded fasteners therethrough, said threaded fasteners cooperative with a groove formed about the associated threaded rod.

4. A pleat forming apparatus as set forth in claim 3 wherein the first pleat arms frictionally support and are telescopingly mounted within second pleat arms wherein the first pleat arms and second pleat arms are positionable relative to one another to provide an adjustable pleat arm length.

5. A pleat forming apparatus as set forth in claim 4 wherein the framework comprises a generally "U" shaped framework and wherein said "U" shaped framework is formed with forwardly extending parallel legs rotatably mounting the first and second threaded rods therethrough.

6. A pleat forming apparatus as set forth in claim 5 wherein the "U" shaped framework includes a spine orthogonally oriented relative to the first and second parallel legs and wherein the spine is formed of a right support bar and a left support bar, the left support bar being telescopingly receivable within the right support bar for accommodating adjustment of the pleat arms relative to one another.

7. A pleat forming apparatus as set forth in claim 6 wherein the right support bar includes a handle pivotally mounted thereto for transport of the apparatus.

* * * * *